US010760847B2

(12) United States Patent
Goodloe

(10) Patent No.: US 10,760,847 B2
(45) Date of Patent: Sep. 1, 2020

(54) COMBINATION LIQUID AND DRY COOLER ASSEMBLY

(71) Applicant: David R Goodloe, Reno, NV (US)

(72) Inventor: David R Goodloe, Reno, NV (US)

( * ) Notice: Subject to any disclaimer, the term of this patent is extended or adjusted under 35 U.S.C. 154(b) by 811 days.

(21) Appl. No.: 15/200,274

(22) Filed: Jul. 1, 2016

(65) Prior Publication Data

US 2018/0003425 A1 Jan. 4, 2018

(51) Int. Cl.

| | |
|---|---|
| ***F25D 3/08*** | (2006.01) |
| ***A45C 11/20*** | (2006.01) |
| ***F25D 31/00*** | (2006.01) |
| ***F25D 25/00*** | (2006.01) |
| ***B65D 21/00*** | (2006.01) |

(52) U.S. Cl.

CPC ..... *F25D 3/08* (2013.01); *A45C 11/20* (2013.01); *B65D 21/00* (2013.01); *F25D 25/00* (2013.01); *F25D 31/002* (2013.01); *F25D 2303/0832* (2013.01); *F25D 2303/0844* (2013.01)

(58) Field of Classification Search

CPC ..... A45C 11/20; A45F 3/16; B65D 21/00; B65D 81/38; B67D 7/80; F25D 3/08

USPC ..... 220/592.15, 592.2, 592.23, 220/592.25–592.27; 62/457.7

See application file for complete search history.

(56) References Cited

U.S. PATENT DOCUMENTS

| | | | | | |
|---|---|---|---|---|---|
| 3,387,650 | A * | 6/1968 | Masshake | A45C 11/20 | 165/75 |
| 3,654,773 | A * | 4/1972 | White | A01K 97/04 | 62/371 |
| 4,286,440 | A * | 9/1981 | Taylor | A45C 11/20 | 206/541 |
| 4,347,713 | A * | 9/1982 | Morrison | B65D 81/383 | 62/371 |
| 5,048,171 | A * | 9/1991 | Bidwell | A47F 3/00 | 220/592.19 |
| 5,437,165 | A * | 8/1995 | White | A45C 11/20 | 62/465 |
| 6,381,981 | B1 * | 5/2002 | Yaddgo | F25D 3/125 | 62/372 |
| 6,763,678 | B2 * | 7/2004 | Harper | F25D 3/08 | 62/461 |
| 2002/0020104 | A1 * | 2/2002 | Kolar | A01K 97/05 | 43/55 |
| 2007/0107459 | A1 * | 5/2007 | Strickland | B65D 25/282 | 62/457.3 |
| 2011/0127274 | A1 * | 6/2011 | Mogil | A45C 11/20 | 220/592.2 |
| 2013/0341338 | A1 * | 12/2013 | Mitchell | A45C 11/20 | 220/592.2 |

* cited by examiner

*Primary Examiner* — Anthony D Stashick
*Assistant Examiner* — L Kmet
(74) *Attorney, Agent, or Firm* — Greg N. Geiser; Gutwein Law

(57) ABSTRACT

A liquid cooler device. The liquid cooler device having an interior cavity with a ledge, the ledge segregating the interior cavity into a lower portion for the placement of liquid and an upper portion for the receipt of an upper tray portion. The upper tray portion including a gasket for engagement with the ledge and designed for the dry storage of bulk items within the interior cavity. In use, the device acts as a combination cooler for both liquids and dry items.

16 Claims, 7 Drawing Sheets

COMBINATION LIQUID AND DRY COOLER ASSEMBLY

CROSS REFERENCE TO RELATED APPLICATIONS

Not Applicable

FIELD OF THE INVENTION

The invention relates generally to a cooler device having designated compartments for the storage of liquids and bulk items.

BACKGROUND

Currently there are a number of solutions for keeping liquids and items at a desired temperature for extended periods of time. One of these solutions is to utilize an insulating device such as a cooler. A typical cooler has an outer shell, an inner shell forming a cavity for the placement of items, and an insulating layer sandwiched between this inner shell and outer shell to maintain temperature within the cavity of the cooler. This typical cooler is available in configurations for both dry goods and liquid goods. The general assembly of each of these coolers is the same with the main difference being the liquid cooler having a spigot on the bottom of the cooler and a generally cylindrical shape. A typical cooler for dry goods is generally rectangular and provides a space for the placement of various items.

For a liquid style cooler, the liquid contents are generally placed directly within the cavity of the container, wherein the insulation of the container aids in maintaining the temperature of the liquid. Often to keep the liquid contents cold, ice is added to the liquid. For a hot liquid, the internal temperature of the liquid is maintained by the insulation of the cooler itself. For dry goods, the cooler is typically packed with items and a cold source such as ice or a cold pack to keep contents cold. Liquid stored within a cooler for dry goods is often kept within separate containers.

Although these typical configurations are very useful for their intended purpose, they are not amenable to use for both bulk liquids and dry goods. Still further, the utilization of two separate coolers take up unnecessary space, is heavy, and requires twice the amount of ice or cooling implements. Therefore, there is a need within the marketplace for an improved cooler that combines a bulk liquid cooler with a dry cooler. Preferably this combination bulk liquid and dry cooler is available in multiple sizes and internal configuration options, is easy to transport, and adaptable to multiple uses.

SUMMARY OF THE INVENTION

An improved cooler apparatus is disclosed. The cooler apparatus is applicable for use as both a liquid dispensing cooler and dry goods storage cooler. Accordingly, the apparatus provides a generally insulated cavity in communication with a spigot for the placement of bulk liquids and an upper tray unit for the placement of dry goods within the insulated cavity. The apparatus is generally formed from an outer wall and inner wall and including a lid, the outer wall and inner wall are in spatial communication and defining an interstitial space. The interstitial space providing an insulating cavity for the placement of an insulating material between the outer wall and inner wall, such as, air, foam, or other similar insulating component.

The upper tray unit is received within an upper portion of the cavity and includes a gasket member, wherein the gasket member secures the upper tray unit within the cavity and forms a vapor barrier within the cavity. The placement of the upper tray unit within the cavity forms a segregated compartment, wherein the cavity is segregated into a liquid cavity and dry goods cavity. In the preferred embodiment of the present invention, the gasket member is accompanied with a threaded connection.

The upper tray unit is configured into various forms and includes additional segregated compartments for the placement of food items. In an alternate embodiment of the present invention, the upper tray unit includes a central aperture, the central aperture allowing for communication with the liquid cavity, wherein the liquid cavity can be refilled and accessed without removal of the upper tray unit. Within this embodiment, the lid additionally includes a lid central aperture aligned with the central aperture of the upper tray unit and a secondary lid to allow for access to the liquid cavity without removal of the entire lid.

The apparatus is provided in several configurations, options, and sizes that follow the structure of the apparatus but allow for use for differing situations. Accordingly, small sizes are applicable for smaller excursions and smaller sized provisions and larger sizes are applicable for extended excursions and larger provisions. These various configurations and sizes are accordingly configured for their use and include handles, wheels, straps, and other similar transportation and grasping aids to provide for easy transport and use.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Figure 1:
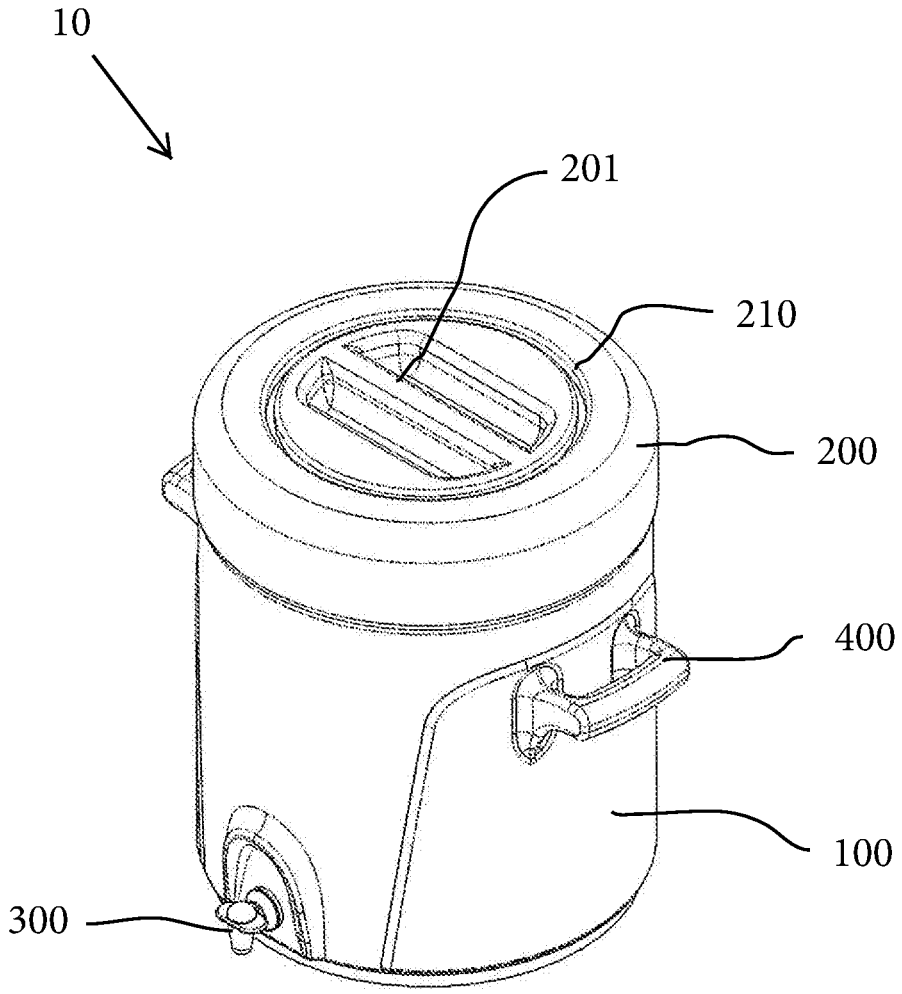
FIG. 1 shows an isometric view of the cooler device, according to the present invention.

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful, and is not intended to exclude other embodiments from the scope of the invention.

These terms are not meant to limit the elements that they describe, as the various elements may be oriented differently in various applications.

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

Figure 2:
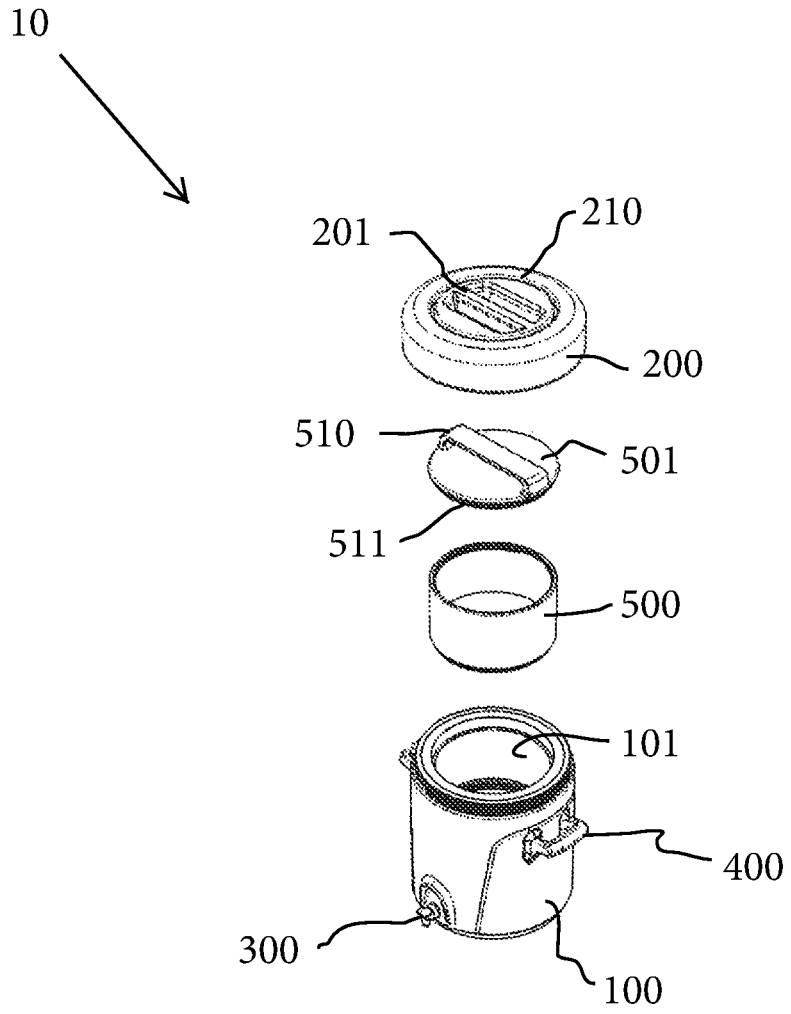
FIG. 2 shows an exploded view of the cooler device, according to the present invention.
Figure 3:
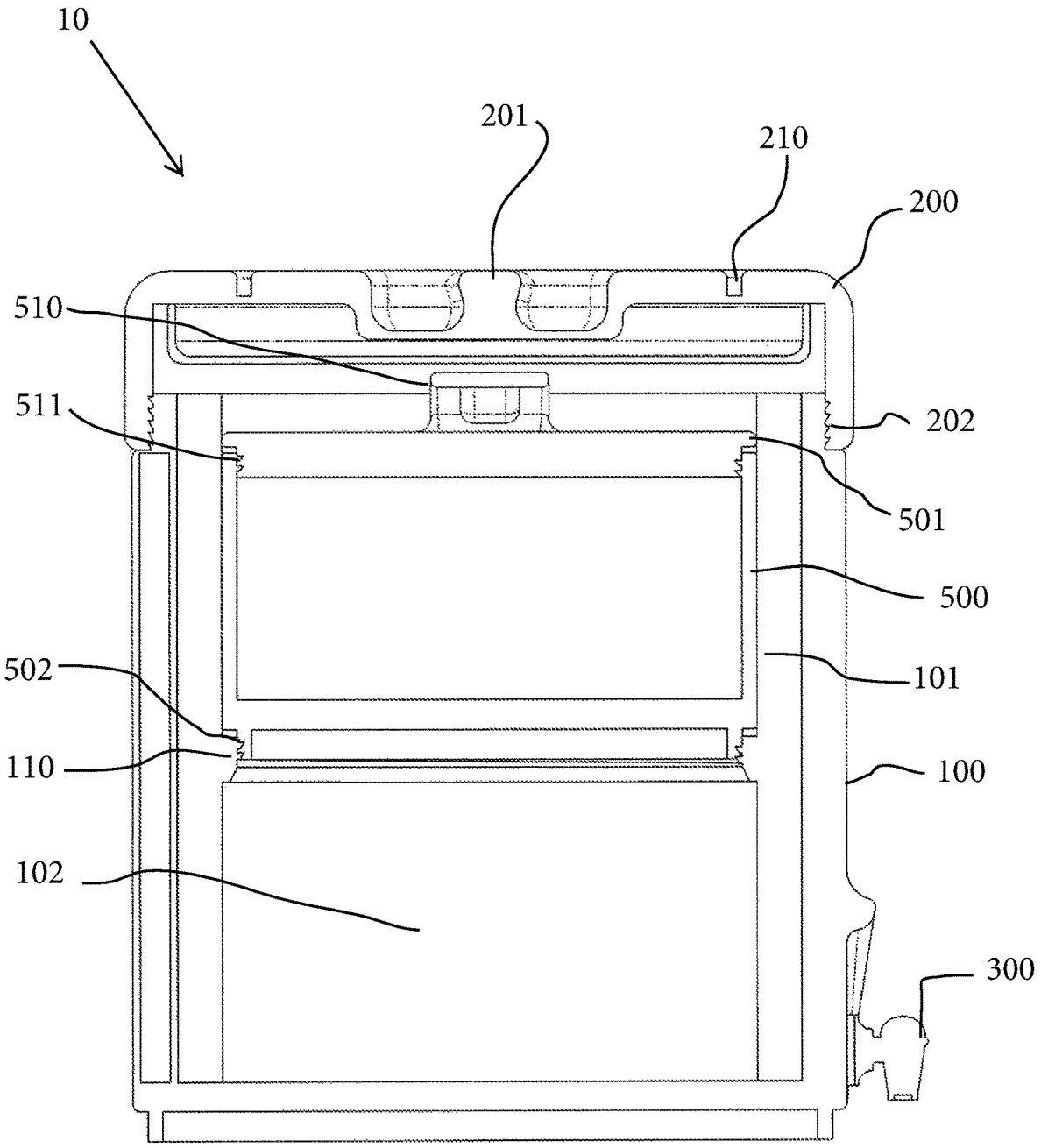
FIG. 3 shows a cross-sectional view of the cooler device, according to the present invention.
Figure 4:
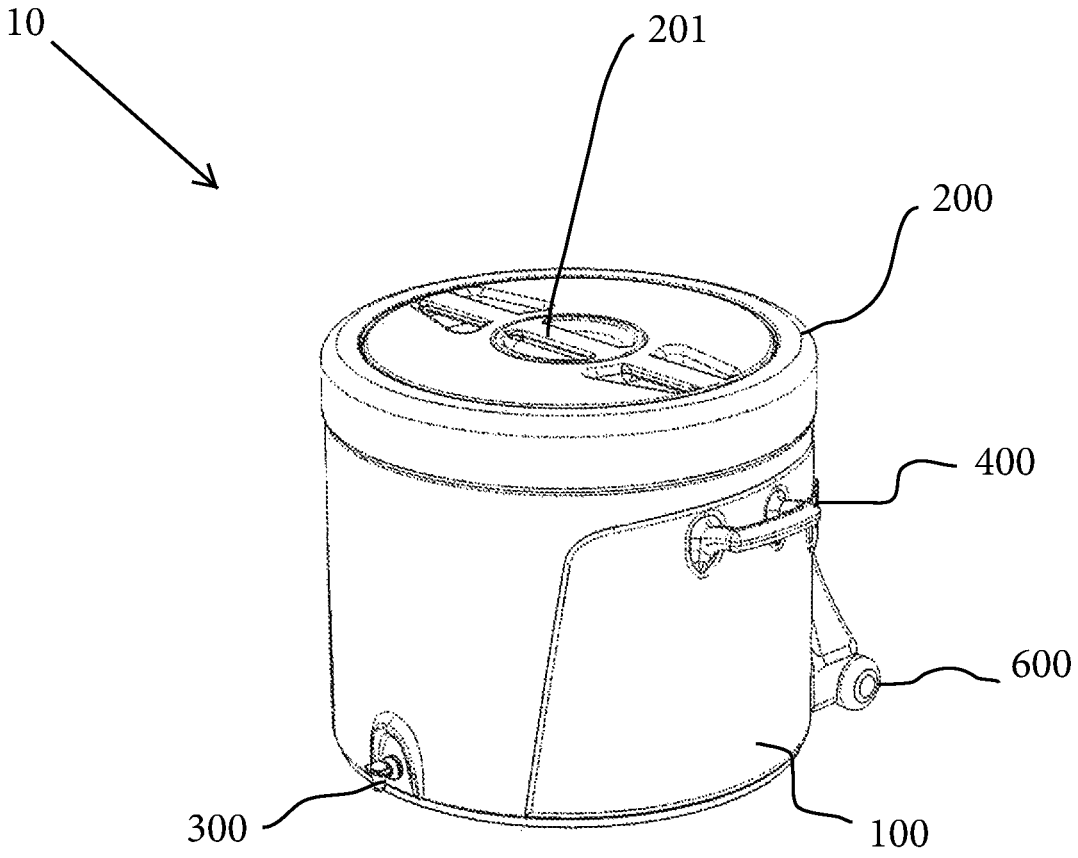
FIG. 4 shows an isometric view of the front side of an alternate embodiment of the cooler device, according to the present invention.
Figure 5:
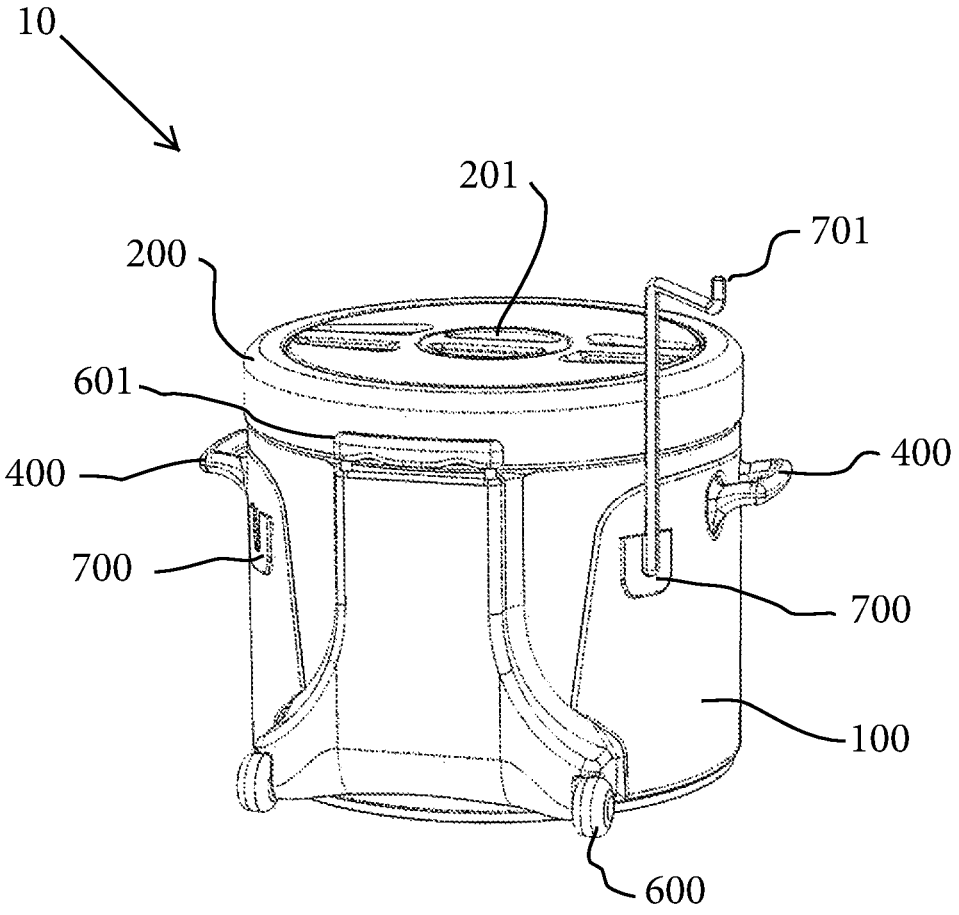
FIG. 5 shows an isometric view of the rear side of an alternate embodiment of the cooler device, according to the present invention.
Figure 6:
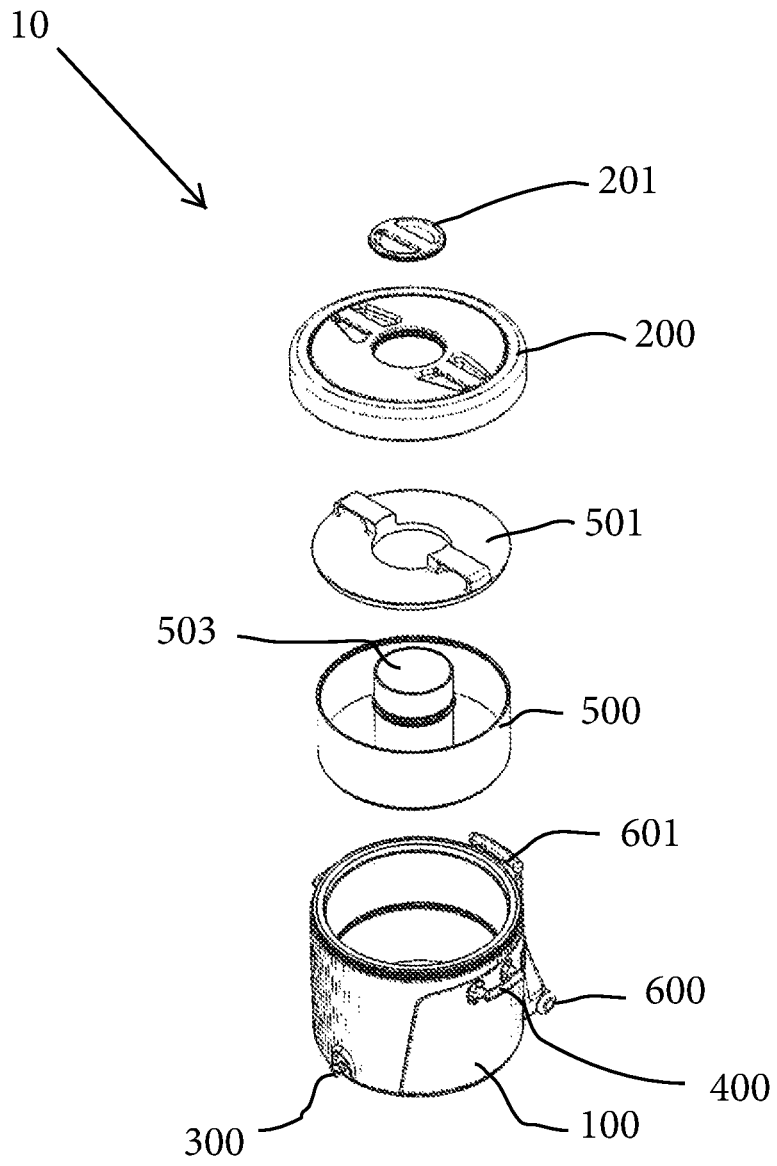
FIG. 6 shows an exploded view of an alternate embodiment of the cooler device, according to the present invention.
Figure 7:
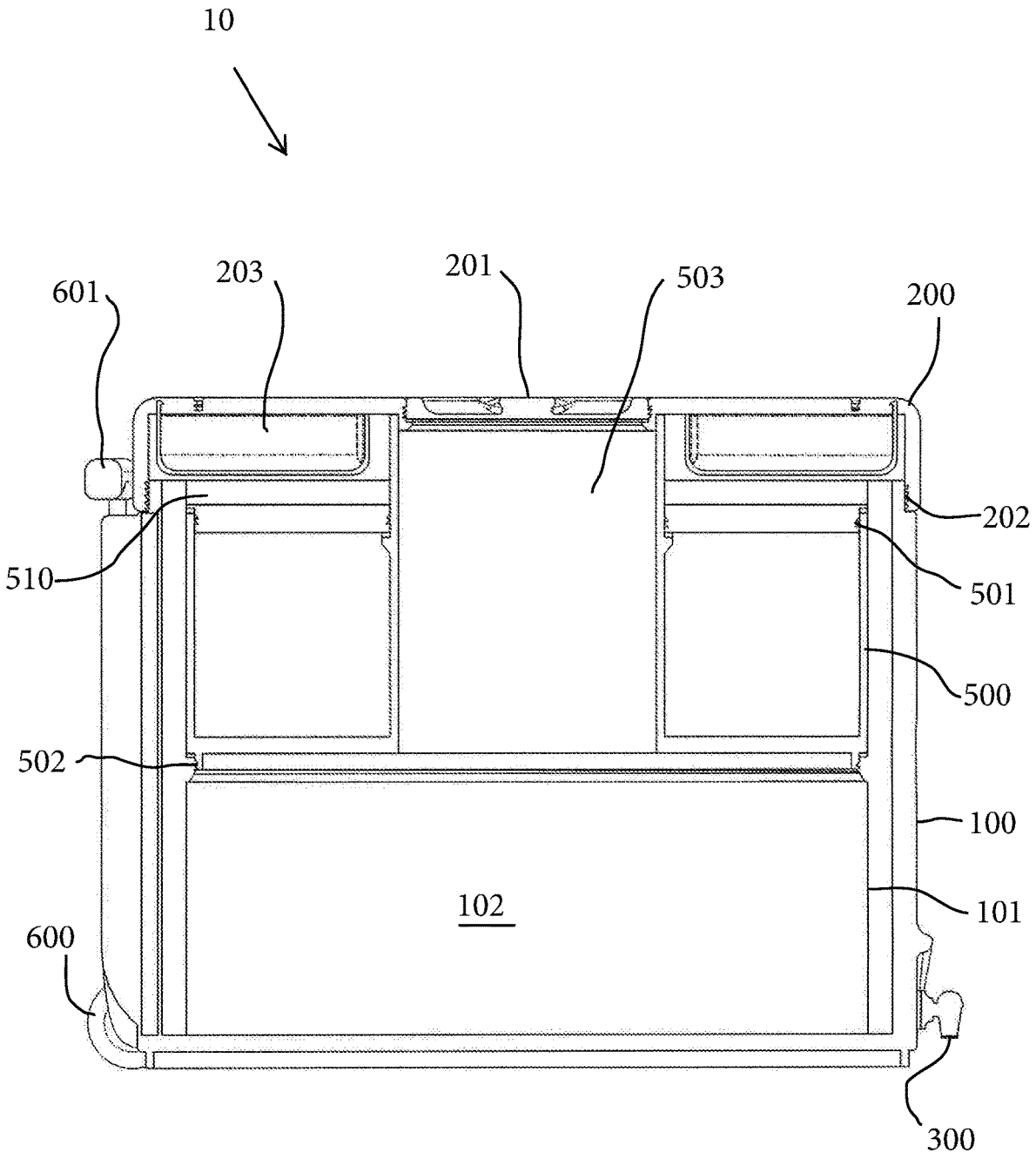
FIG. 7 shows a cross-sectional view of an alternate embodiment of the cooler device, according to the present invention.

Referring now to FIGS. 1-7, the invention is directed to a combination liquid and bulk storage cooler device, generally referred to as device 10. The device 10 is generally cylindrical and provided from a structure having an outer wall 100 and inner wall 101, wherein the interstitial space between the outer wall 100 and inner wall 101 includes an insulating means. The insulating means providing an insulating layer for the retaining of temperature within the device 10. The inner wall 101 defining a cavity for the placement of liquids and items and including a bottom wall and an open top portion. The inner wall 101 having a ledge 110. The ledge 110 extending into the interior cavity and providing a resting support member for the placement of an upper tray unit 500.

The upper tray unit 500 includes a bottom side in communication with a gasket 502. The gasket 502 extending along an entire edge of the bottom side and sized and shaped to engage the ledge 110, wherein the gasket 502 and ledge 110 are coupled together to create a moisture and vapor barrier. Preferably, this coupling is a threaded connection, wherein the gasket 502 is threaded into a corresponding groove on the ledge 110. The engagement of the gasket 502 of the upper tray 500 bottom onto the ledge 110 segregates the cavity into two compartments, the upper tray unit 500 comprising an upper portion of the device and the area below the engaged upper tray 500 forming a cavity 102 for the placement of liquid.

The upper tray unit 500 includes a lid 501, the lid 501 having a handle 510. The lid 501 removably secured to the upper tray unit 500 to enclose the upper tray unit 500 during use. In the preferred embodiment of the present invention, the handle 510 includes a trigger member that is spring-loaded and coupled to a sealing member 511, wherein the sealing member 511 is in frictional communication with the upper tray unit 501 and engaged through the handle 501. The handle 510 trigger member and sealing member 511 coupling includes communication with a tab member. The tab member is secured within a corresponding aperture on the upper tray unit 500, wherein the lid 501 locks into the upper tray unit 500. This locking mechanism allows the user to affix and remove the upper tray unit 500 from the ledge 110.

The cavity 102 is in communication with a liquid delivery means 300, wherein the liquid delivery means is coupled to an exterior of the device 10 and capable of delivering liquid stored within the cavity 102 to a separate container. Preferably the liquid delivery means 300 is a spigot or spigot-like device. Preferably the spigot 300 is capable of one-handed operation and includes a push-button operation means and tapered spout. Preferably, this push-button operation means is spring-loaded and includes a slip resistant top surface, such as a rubber or rubber-like material.

The device 10 includes a lid 200. The lid 200 is received on an upper portion of the device 10 and securing and enclosing the device 10 internal portion. The lid 200 includes a handle portion 201 to aid in placement and removal of the lid 200 onto the device 10. Preferably, the lid 200 is coupled onto the device 10 though threaded communication 202 with the device 10 upper side, wherein the lid 200 is screwed onto the device 10. The lid 200 upper surface includes a groove 210. The groove 210 surrounding a perimeter of the lid 200 upper surface and sized and shaped according to the size and shape of the upper tray portion 500 bottom, wherein the bottom portion of the upper tray portion 500 is secured and retained within this groove when placed on top of the lid 200.

The device 10 includes handles 400, the handles 400 located on opposed sides of the exterior of the device 10 and provide a grasping surface to allow a user to pick up and move the device 10.

In use, the device 10 is utilized to provide storage for bulk liquids within the cavity 102 and dry items within the upper tray unit 500. A user will fill the cavity 102 with their desired liquid through the top side of the device 10 with the upper tray unit 500 removed to a height of the cavity 102 slightly below the ledge 110. The upper tray unit 500 is then placed within the interior of the device 10 and received on the ledge 110. Dry items are placed within the upper tray unit 500. The lid 200 is then placed on the device 10 top to secure the internal contents of the device 10. The liquid within the cavity 102 is accessed through the liquid delivery means 300 when it is placed within a container.

Referring now specifically to FIGS. 4-7 an alternate embodiment of the device 10 is shown. The device 10 is provided in a larger size with additional features to provide for increased usability. Accordingly, the device 10 is modified on both its exterior and interior. The device 10 exterior includes wheels 600, a telescopic handle 601, accessory holder 700, and accessory 701. The wheels 600 and telescopic handle 601 work in combination to allow the device 10 to be moved and transported when the device 10 is near full capacity.

The interior of the alternate embodiment of the device 10 includes modifications to the device 10 lid 200 and upper tray unit 500.

The accessory holder 700 provides a tab-like element to receive an accessory 701 that is removably coupled to the accessory holder 700. The accessory 700 including but not limited to small tables, cup dispensers, towel racks, lanterns, and other similar accessories that may be useful for use of the device 10.

Within this alternate embodiment, the upper tray unit 500 includes a central aperture 503. This central aperture 503 open and centrally located on the upper tray unit 500, wherein the central aperture 503 provides access to the cavity 102 below the upper tray unit 500. The central aperture 503 allows a user to fill-up or refill the liquid contents of the cavity 102 without the removal of the upper tray unit 500. To accommodate refilling of the cavity 102 without the removal of the lid 200, the lid 200 of the alternate embodiment of the present invention includes a removable lid central portion 201 aligned with the central aperture 503 and in spatial communication with the cavity 102.

The lid 200 of the alternate embodiment of the present invention of the device 10, includes a compartment 203 located on an underside of the lid 200. The compartment 203 of the lid 200 is primarily designed to utilize the underside of the lid 200 for the storage and placement of an ice pack or ice packs to keep the contents of the device cold.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

What is claimed is:

1. A thermal insulating device, the thermal insulating device providing storage for both liquids and dry items in combination, the thermal insulating device comprising:

an outer wall, the outer wall defining a generally cylindrical shape of the device and having a bottom wall and side walls;

an inner wall, the inner wall interior to the outer wall a spatial distance, the inner wall defining a cavity of the device, the inner wall having a ledge, the ledge extending into the interior of the cavity and defining a threaded resting support;

an insulating layer, the insulating layer between the outer wall and the inner wall, the insulating layer designed to maintain the internal temperature of the device;

an upper tray unit, the upper tray unit sized for removable receipt within the inner wall, the upper tray unit having a bottom side, the bottom side having a casket being threaded into a corresponding groove of the ledge, wherein the upper tray unit is placed within the inner wall and threaded on the ledge to segregate the interior cavity into an upper part and a lower part, the upper tray unit having a lid, the lid removable and sized for receipt on an upper portion of the upper tray to selectively enclose the upper tray unit, the lid having a handle;

a liquid delivery means, the liquid delivery means on the exterior wall of the device and in communication with the lower part of the cavity; and a lid, the lid coupled to the sidewalls opposite the bottom wall, the lid removably enclosing the device.

2. The thermal insulating device as in claim 1, wherein the liquid delivery means is a spigot.

3. The thermal insulating device as in claim 1, wherein the device exterior includes a pair of handles, the handles on opposed sides of the device and designed to aid in carrying of the device.

4. The thermal insulating device as in claim 1, wherein the device exterior includes wheels, the wheels to aid in transportation of the device.

5. The thermal insulating device as in claim 1, wherein the lid has a top side including a groove, the groove sized for receipt of the bottom side of the upper tray unit, wherein the upper tray unit is securely seated within this groove when placed on the lid topside.

6. The thermal insulating device as in claim 1, wherein the insulating layer is a foam material.

7. The thermal insulating device as in claim 1, wherein the upper tray unit includes a central aperture, the central aperture in communication with the lower part of the cavity when the upper tray unit is engaged within the inner wall of the device.

8. The thermal insulating device as in claim 7, wherein the lid includes a removable lid central portion, the removable lid central portion aligned with the central aperture, wherein removal of the removable lid central portion provides access to the lower part of the cavity for the filling or refilling of liquids.

9. A liquid cooler device, the liquid cooler device cylindrical in shape and providing storage for both liquids and dry items in combination, the liquid cooler device comprising:

a cavity; the cavity forming an interior of the cooler device, the cavity having a threaded ledge, the threaded ledge provided on a height of the interior and segregating the cavity into an upper portion and a lower portion, the lower portion providing an area for the placement of a liquid;

an outer wall, the outer wall defining the cylindrical shape of the device and having a bottom wall and side walls;

an inner wall, the inner wall interior to the outer wall a spatial distance, the inner wall defining the cavity of the device;

an insulating layer, the insulating layer between the outer wall and the inner wall, the insulating layer designed to maintain the internal temperature of the device;

an upper tray unit, the upper tray unit sized for removable receipt within the cavity upper portion, the upper tray unit having a bottom side, bottom side having a gasket being threaded into a corresponding groove on the ledge, wherein the upper tray unit is screwed into the inner wall and rested on the threaded ledge, the upper tray unit having a lid, the lid removable and sized for receipt on an upper portion of the upper tray to selectively enclose the upper tray unit, the lid having a handle;

a liquid delivery means, the liquid delivery means on the exterior wall of the device and in communication with the lower portion of the cavity; and a lid, the lid coupled to the sidewalls opposite the bottom wall, the lid removably enclosing the device.

10. The liquid cooler device as in claim 9, wherein the liquid delivery means is a spigot.

11. The liquid cooler device as in claim 9, wherein the device exterior includes a pair of handles, the handles on opposed sides of the device and designed to aid in carrying of the device.

12. The liquid cooler device as in claim 9, wherein the device exterior includes wheels and a telescopic handle, the wheels and handle aid in transportation of the device.

13. The liquid cooler device as in claim 9, wherein the lid has a top side including a groove, the groove sized for receipt of the bottom side of the upper tray unit, wherein the upper tray unit is securely seated within this groove when placed on the lid topside.

14. The liquid cooler device as in claim 9, wherein the insulating layer is a foam material.

15. The liquid cooler device as in claim 9, wherein the upper tray unit includes a central aperture, the central aperture in communication with the lower part of the cavity when the upper tray unit is engaged within the inner wall of the device.

16. The liquid cooler device as in claim 15, wherein the lid includes a removable lid central portion, the removable lid central portion aligned with the central aperture, wherein removal of the removable lid central portion provides access to the lower part of the cavity for the filling or refilling of liquids.

* * * * *